US008266740B2

(12) United States Patent
Baird et al.

(10) Patent No.: US 8,266,740 B2
(45) Date of Patent: Sep. 18, 2012

(54) METHOD AND APPARATUS FOR CLEANING A CONDUIT

(75) Inventors: Jeffery D. Baird, Ada, OK (US); Kent Beck, Copper Canyon, TX (US)

(73) Assignee: PF WaterWorks LP, Houston, TX (US)

( * ) Notice: Subject to any disclaimer, the term of this patent is extended or adjusted under 35 U.S.C. 154(b) by 1098 days.

(21) Appl. No.: 12/085,379

(22) PCT Filed: Aug. 14, 2006

(86) PCT No.: PCT/US2006/031633
§ 371 (c)(1),
(2), (4) Date: May 21, 2008

(87) PCT Pub. No.: WO2007/067227
PCT Pub. Date: Jun. 14, 2007

(65) Prior Publication Data
US 2009/0100619 A1 Apr. 23, 2009

(51) Int. Cl.
*E03C 1/12* (2006.01)

(52) U.S. Cl. ..... 4/679

(58) Field of Classification Search ..... 4/679, 681, 4/256.1; 137/247.41, 247.43, 247.51
See application file for complete search history.

(56) References Cited

U.S. PATENT DOCUMENTS

| | | | | |
|---|---|---|---|---|
| 232,376 | A | 9/1880 | Staples | |
| 1,884,855 | A | 10/1932 | Pryce | |
| 2,059,733 | A | 11/1936 | Heisser | |
| 2,166,279 | A | 7/1939 | Barwick | |
| 2,424,548 | A | 7/1947 | Bell et al. | |
| 2,610,696 | A | 9/1952 | Mayberry | |
| 2,627,610 | A | 2/1953 | Hirshstein | |
| 3,526,547 | A | 9/1970 | Shock | |
| 3,872,521 | A | 3/1975 | Friedman | |
| 4,301,554 | A | 11/1981 | Wojcicki | |
| 4,615,053 | A | 10/1986 | Masalin et al. | |
| 4,700,412 | A | 10/1987 | Manuel | |
| 4,949,406 | A | 8/1990 | Canelli | |
| 5,075,905 | A | 12/1991 | Rutherford | |
| 6,385,799 | B1 | 5/2002 | Doyen | |
| 6,862,754 | B1 * | 3/2005 | DeMarco | 4/304 |
| 6,915,814 | B2 | 7/2005 | Cheng | |
| 7,107,634 | B1 * | 9/2006 | Baird | 4/679 |

OTHER PUBLICATIONS

PCT International Search Report and Written Opinion mailed Feb. 5, 2007, for corresponding International Application No. PCT/US2006/031633.

* cited by examiner

*Primary Examiner* — Huyen Le
(74) *Attorney, Agent, or Firm* — Stephen S. Hodgson

(57) ABSTRACT

A conduit cleaning method and apparatus for connection to a fluid inlet feed line and an outlet drain line utilizes a housing assembly having an inlet portion, an outlet portion, and a bight portion. The inlet and outlet portions have sloped leg sections which provide increased fluid flow through the bight to disperse accumulated debris. Rotatable shafts inside the housing accommodate paddles or jets to facilitate in retrieval or dispersal of obstruction.

40 Claims, 8 Drawing Sheets

METHOD AND APPARATUS FOR CLEANING A CONDUIT

BACKGROUND OF THE INVENTION

The present invention relates to an improved method and apparatus for cleaning the fluid flow path in a conduit. The present invention may be utilized to clean drain lines in any application, whether commercial or residential, and is not necessarily limited to sewage systems. More particularly, the present invention relates to an apparatus and method for clearing a build-up in a trap within a drainage system which may be impeding the flow of fluid from the system discharge. The present invention has an embodiment wherein the dynamic for clearing the flow path is supplied by angular arrangement and orientation of the inlet and outlet piping legs of the apparatus.

In most drainage systems, traps are provided to catch or collect materials passing through the system. In commercial and residential plumbing systems, traps are used to capture items falling into the drain, so that they do not pass directly through the drain line and into the main sewer system. They are also intended to block sewer gas bleed back into the building. However, the traps often accumulate excessive amounts of debris and build-up blocking the drainage flow through the system.

Existing devices are cumbersome and ineffective. Many of these "solutions" create other problems for the user, including actually interfering with the drainage flow when not in operation. Any device which restricts the full volume flow through the bight of a trap when not in use potentially will cause more problem than it solves.

The present invention provides embodiments to maintain a clean flow passage. In one embodiment, the design of the inlet and outlet passages provides unique flow characteristics so that the device has a self cleaning action. The design of the approach angle of the device and the exit angle of the outlet portion of the device is critical to the self cleaning nature of a trap. A typical trap system is generally U-shaped and has inlet and outlet piping that is substantially vertical in relation to the bight of the trap body. Fluid flowing into the conventional trap tends to migrate to the inside center of the pipe. When this happens, the inflowing fluid loses its ability to carry solids effectively. Furthermore, when the inflowing fluid reaches the substantially horizontal section of the trap or the bottom on the U-shape, the inflowing fluid has lost much of its energy and thus allows solids to remain in the bottom or nadir, of the trap. The present invention maximized the solids carrying ability of the inflowing and outflowing fluid. The inlet leg of one embodiment is designed to redirect the flow of the inflowing fluid and, thus, cause solids in the flow path turbulently to mix with the fluid so that solids may be removed efficiently as the fluid and solids exit the trap device.

A further feature of the present design is the recessed trap area at the nadir of the trap. Since the incoming fluid flow has been directed by the angle of the inlet leg, an area of turbulence near the bottom of the trap is created that tends to "float" or maintain the dispersion of the solids so that the solids may be easily discharged through the angular outlet leg portion of the device. It should be further understood that the shape of the flow path is important to the removal of the solids. The present design provides a round or oval cross-section of the entire fluid flow path in the trap, which creates maximum flow efficiency. One trap design, as described in U.S. Pat. No. 6,385,799, utilizes parallel sides and a somewhat rectangular cross-section. Those skilled in the art will understand that parallel sided conduits create "dead" areas of lost flow energy which result in less turbulence and inefficient solids removal from the trap.

In yet another embodiment, the user is able to rotate a cleaning or object retrieval member through the trap assembly bight without removing the trap body from connected plumbing and to position the cleaning or object retrieval member such that the full volume flow through the bight diameter is not restricted when the member is not being rotated through the flow path. The present invention may be manually operated or attached to a sensor system having a mechanism to periodically rotate the cleaning member either based simply on a selected time interval or dependent upon pressure or flow rate characteristics within the drain system. Additionally, the present invention provides an embodiment wherein the cleaning member rotates on a common journal with a fluid-driven power wheel or electric motor.

Another unique feature of the present invention is that the device is transparent or translucent to allow the user to observe the condition of the trap to observe when cleaning may be required. This transparency or translucency also allows the user to observe an object dropped into the drain so it can be retrieved or otherwise removed.

Another unique feature of the present invention provides for the application of a hydrophobic material which reduces the surface tension of the internal conduit which reduces the friction between the conduit wall and the fluid which improves its solids carrying efficiency.

Another unique feature of the present invention provides for the application of an antibacterial material which will prevent the growing of bacteria in the trap area which can impede the fluid flow.

Further yet, it has been found that the cleaning of the flow path may be facilitated by disposing a fluid jet adjacent the nadir of the flow path. Several embodiments of this "jet trap" are disclosed herein.

While the present invention is described and illustrated in a preferred embodiment within a plumbing/sewer environment, it will be understood that the present invention could be adapted for use in industrial situations where product in a pipeline periodically may need to be flushed or wiped from the pipeline. In such situations, the present invention may not function as a trap, but rather as an inline cleaning or clearing apparatus.

DETAILED DESCRIPTION OF THE PREFERRED EMBODIMENT

Figure 1:
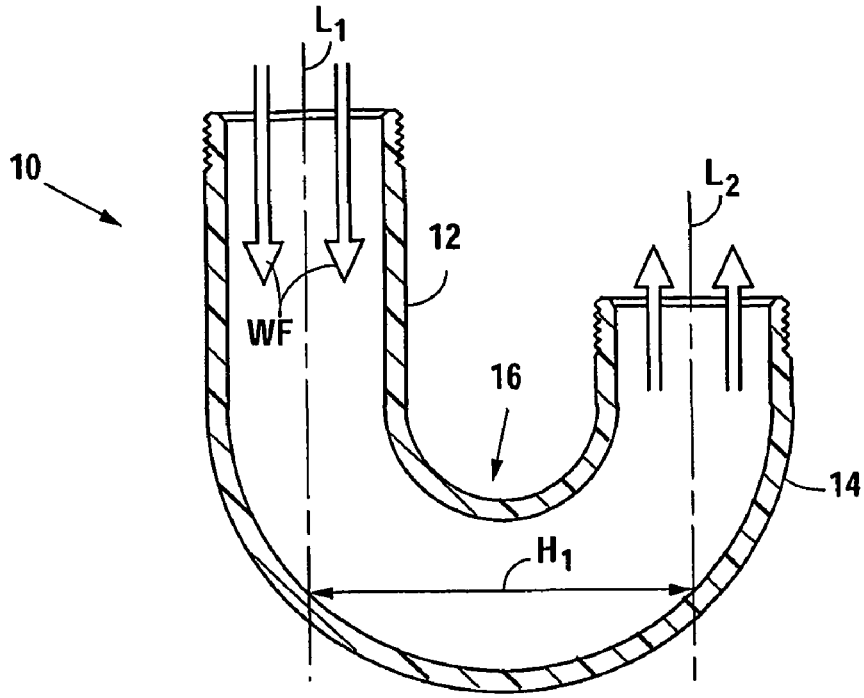
Fig. 1 (PRIOR ART)
FIG. 1 illustrates a prior art, well-known drain trap which may be connected to a sink and a drain line.

FIG. 1 illustrates a typical (prior art) drain trap 10 which attaches to a sink and drain line (not shown). The trap 10 has a U-shaped configuration with a generally vertical inlet 12 and outlet 14 piping leg sections each having a longitudinal axis $L_1$ and $L_2$ extending therethrough. Between the vertical legs 12 and 14, in the bight 16 of the trap is a region $H_1$, where there is a low energy of flow of water through the trap. The water flow WF into the bight from inlet leg 12 is focused in the center section of the leg and when it reaches the bight considerable flow energy has been lost. Thus in the conventional trap, debris falling to the nadir of the bight does not experience much agitation or turbulence. This is a reason for the development of clogs and build-ups which obstruct the flow of fluid through the trap.

Figure 2:
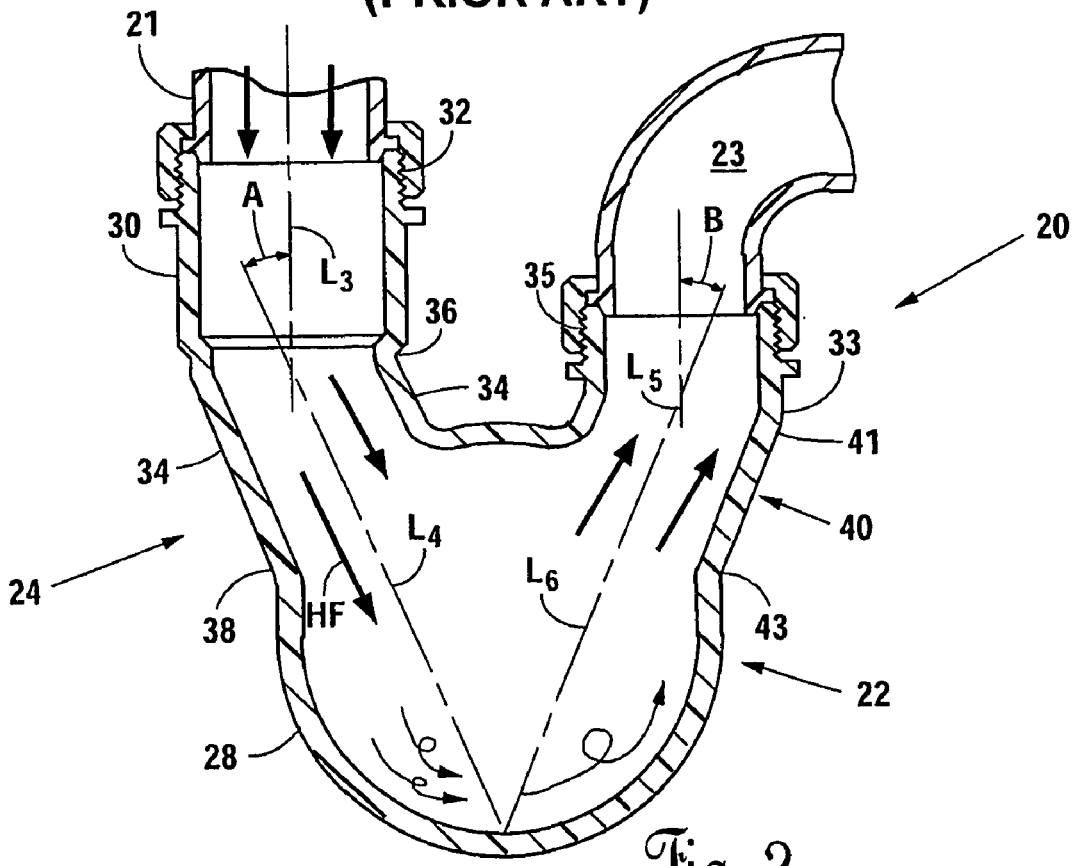
FIG. 2 shows a side elevation view of one embodiment of the present invention as it would be connected to a fluid inlet feed line and an outlet drain line.
Figure 7:
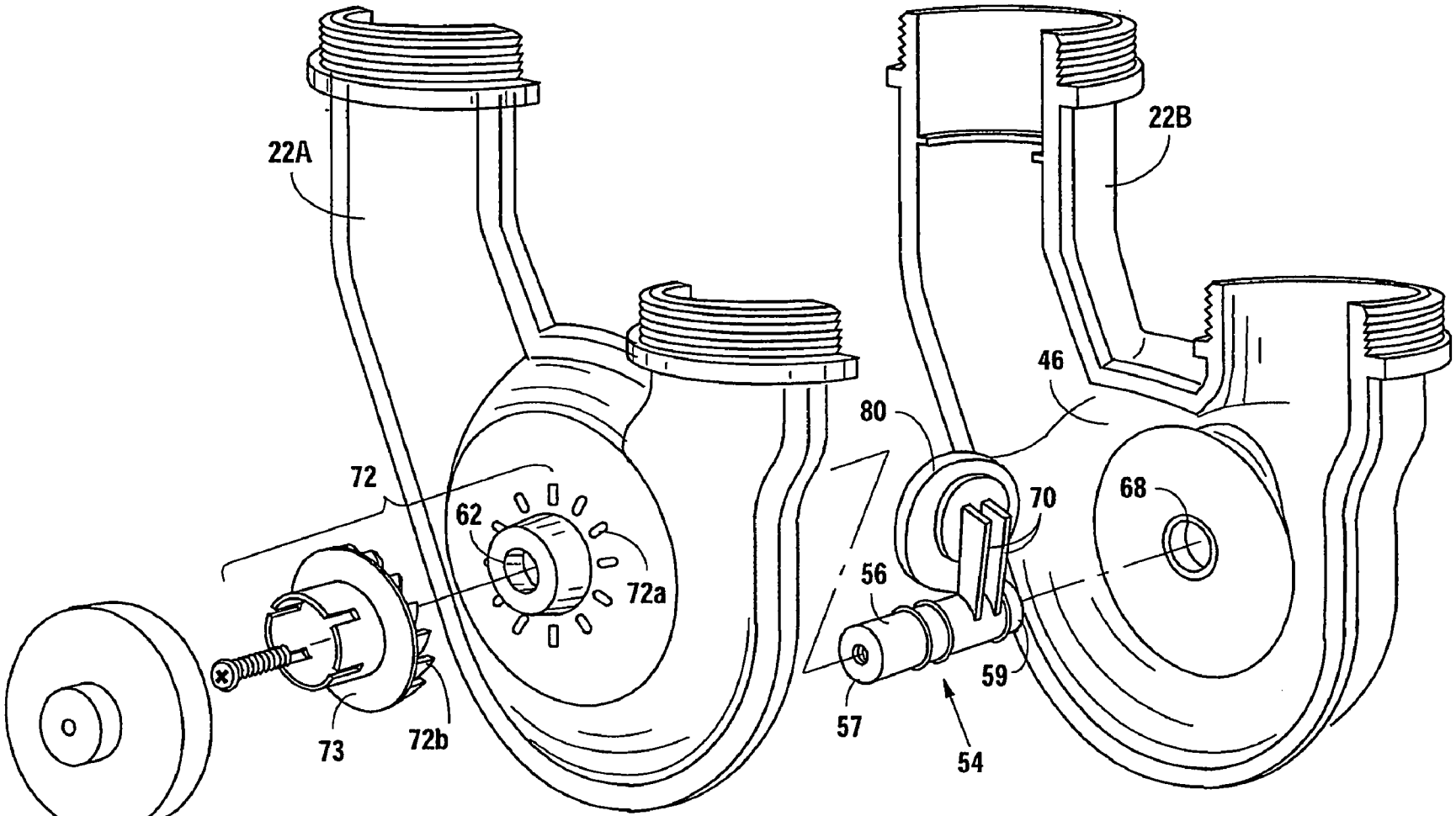
FIG. 7 is an exploded perspective of one embodiment of the present invention showing the two sections of the housing assembly, the rotation member, a one-direction ratchet mechanism, and a rotation knob.

A basic embodiment 20 of the present invention is shown in FIG. 2 in a side elevation view attached to an inlet feed line 21 and an outlet drain line 23. It should be understood by one of ordinary skill in the art that standard piping and conduit structures may be used to form the present invention. Circular or oval tubing may be utilized. A split housing assembly 22 may be made of rugged plastics or other suitable materials. The housing assembly may be transparent or translucent to improve the visibility of the conditions inside the housing assembly 22. (FIG. 7 illustrates the two halves 22A and 22B of the housing 22.)

The apparatus 20 is also provided with a tubular inlet portion 24, a tubular outlet portion 26, and a bight portion 28 connecting the inlet portion and the outlet portion thus forming a fluid flow path through the apparatus 20. An inlet connector member 30 has a standard threaded coupling 32 at a first end for attachment to a complementary coupling on the inlet feed line (not shown). The inlet connector member has a generally vertical orientation when attached to the inlet feed line and a longitudinal vertical axis $L_3$ extends through the central tubular section of the inlet connector member. This short vertical connector member 30 enables the present invention to easily replace existing conventional traps. Member 30 allows for proper plumbing alignment and for the insertion of the inlet feed line into the connector member 30 for proper pipefitting.

Unlike the conventional trap 10, apparatus 20 has a sloped inlet leg portion 34 extending from a first end 36 at the connector member 30 to a second end 38 at the bight portion 28. The inlet leg portion 34 is tubular with a circular or oval cross-section. A longitudinal axis $L_4$ extends through the central part of the inlet leg portion at an inclined or sloped angle A. While improved operation may be achieved with low approach angles (greater than approximately 5°), it is believed that significant improvement is obtained with an inclined or sloped angle A in the range of from approximately 15° to a range of approximately 35° from the vertical longitudinal axis $L_3$ of the inlet connector member 30. Maximum efficiency may be achieved when angle A is approximately 20°.

Apparatus 20 further has a unique sloped outlet leg portion 40 extending from a first end 41 at an outlet connector member 33. The outlet connector member 33 is similar to the inlet connector member 30 and has a thread coupling 35 for attachment to a complementary coupling on the outlet drain line (not shown). The outlet connector member 33 has a generally vertical orientation when attached to the outlet drain line and a longitudinal vertical axis $L_5$ extends through the central tubular section of the outlet connector member 33. As with the inlet connector member 30, the outlet connector member 33 allows for plumbing alignment and for insertion of the outlet drain line into the connector member 33 for proper pipefitting.

Outlet leg portion 40 is tubular with a circular or oval cross-section. A longitudinal axis $L_6$ extends through the central part of the outlet leg portion at an inclined or sloped angle B. Again, there is improvement even when angle B is low (greater than about 5°). Significant improvement may be achieved with angle B in the range of from approximately 15° to a range of approximately 35° from the vertical longitudinal axis $L_5$ of the outlet connector member 33. Maximum efficiency may be achieved when angle B is approximately 20°.

This simple, but unique, angular configuration and arrangement of the inlet and outlet leg portions of the apparatus 20 provides for enhanced flow dynamics within the housing and especially the bight, thereby reducing buildups in the flow path of the device.

Figure 3:
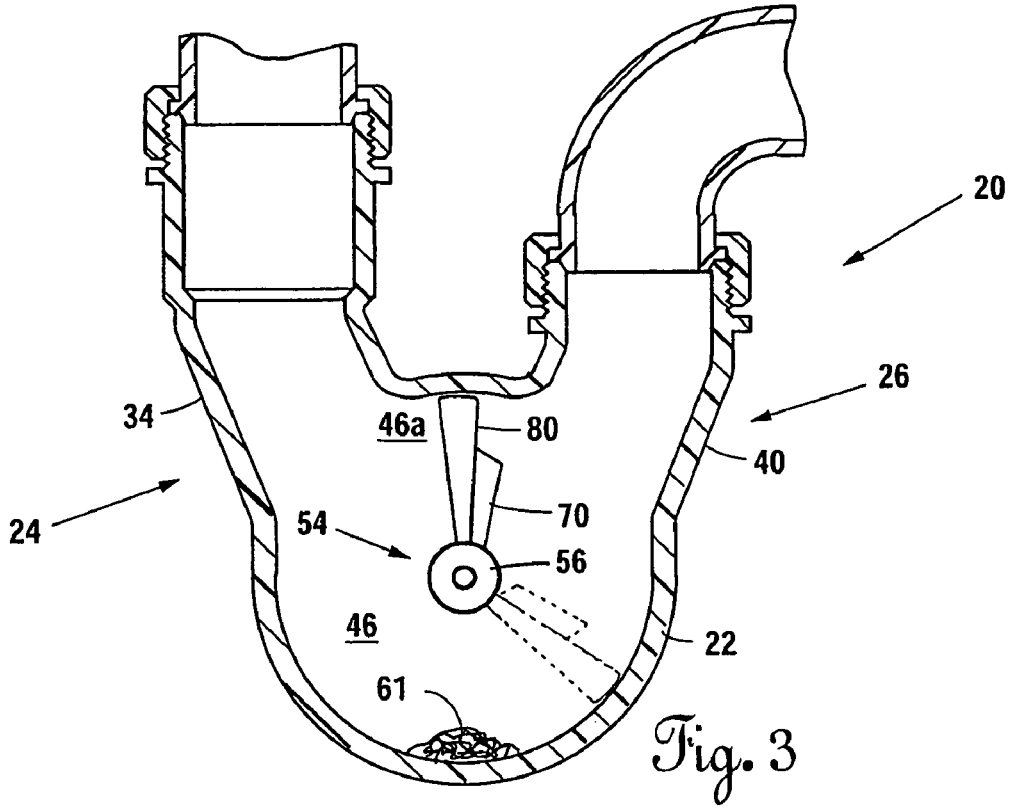
FIG. 3 is a side elevation view of one embodiment of the present invention with a rotation member at a first position inside the housing assembly. The rotation member is shown in broken lines in a next position moving toward an object or debris in the nadir of the trap.

Turning to FIGS. 3 and 7, one embodiment of the present invention includes a rotation member 54 within the chamber 46 of the housing assembly Member 54 moves an object or debris 61 from the bight up into the fluid flow path in inlet leg portion 34. As would be understood by one of ordinary skill in the art, one end 57 of the journal 56 extends through a journal opening in the side of first housing half 22A. The opening 62 is provided with journal bearing shoulder an appropriate seals to support the journal 56 and prevent leakage around the journal. A rotation hub or handle 60 may be affixed to the journal to assist the user in rotating the member 54. The opposite end 59 of the journal 56 is appropriately supported and sealed in a support shaft bearing shoulder 68 in the second housing half 22B.

It should be further understood that the end 59 of journal 56 could be extended to project through the housing wall of half 22B, the housing wall provided with appropriate seals and bearings so as to enable the rotation member 54 to be rotated or driven on either side of the housing assembly 22.

The rotation member 54 has a plurality of spaced apart teeth 70 extending radially from the journal 56. Teeth 70 shovel, scrape or scoop debris or buildup from the flow path in the bight of the apparatus. A paddle member 80 is also provided on the rotation member 54. Paddle 80 may be rigid or flexible as it extends radially from the journal 56. The paddle trails the teeth 70 and, in operation, may wipe the inner bight walls during rotation moving loosened sludge or buildup out of the chamber 46 and into the inlet leg portion 34. FIG. 3 illustrates the movement of rotation member 54, teeth 70, and paddle 80 from a first position (out of the flow path) to a position near an object or debris 61. The rotation of member 54 is one-direction movement (shown in FIG. 3 as clockwise) from the outlet portion 26 toward the inlet portion 24. The direction of rotation ensures that large objects or undispersed debris are not inadvertently urged toward the outlet drain line thereby potentially causing a blockage or plug which is outside of the reach or range of the rotation member. By moving debris toward the inlet portion, the fluid flow energy breaks up the debris into small segments allowing it to be more easily flushed from the apparatus.

Figure 4:
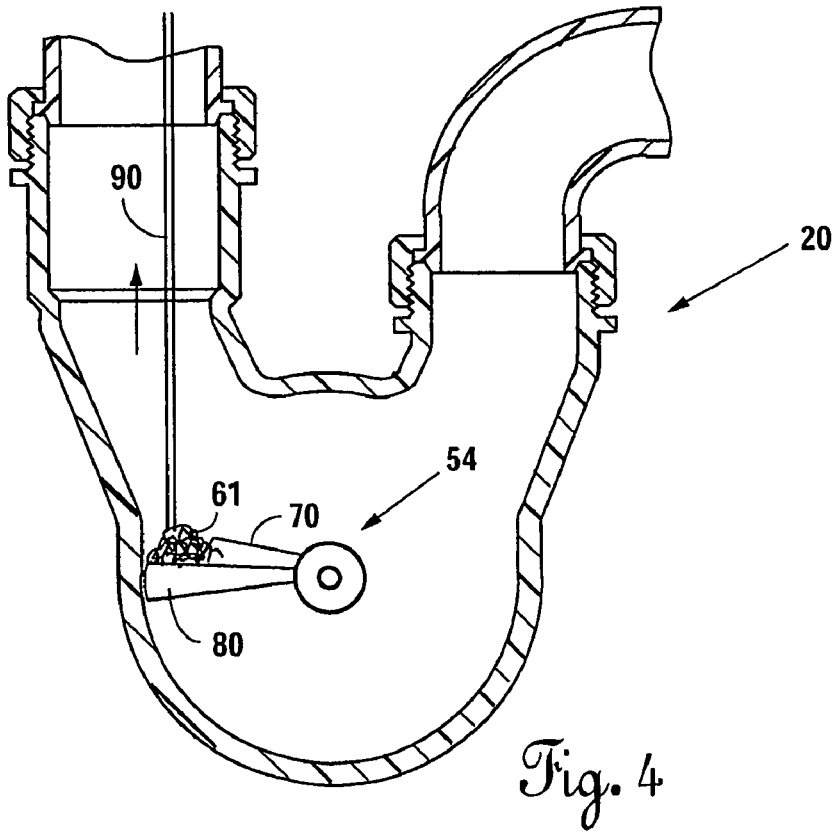
FIG. 4 illustrates a side elevation view of the embodiment of FIG. 3, wherein the object or debris has been scooped onto the rotation member and is being retrieved through the inlet using a hook or appropriate tool.

FIG. 4 shows a situation where the object or debris 61 has been scooped and moved to another position within the apparatus 20 at the inlet leg portion 34. FIG. 4 illustrates the use of an appropriate tool 90 to retrieve the object or debris by fishing downwardly through the inlet feed line into the inlet leg portion 34.

Figure 5:
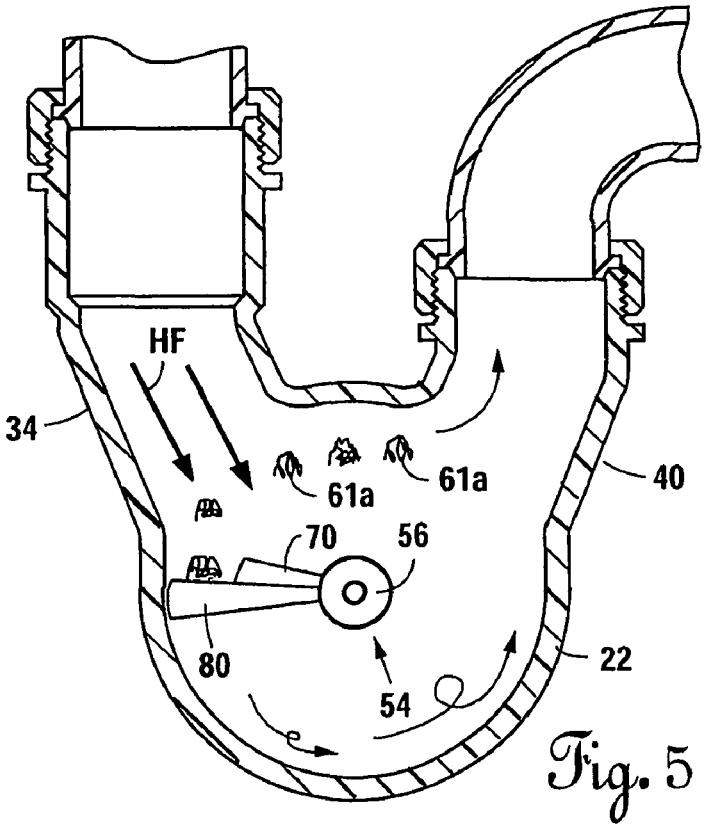
FIG. 5 shows the side elevation view of the embodiment of FIG. 3, wherein the debris is being dispersed by the inflowing fluid from the inlet leg of the device. The debris is flowing out the outlet leg.

As previously discussed, the one-direction rotation of member 54 moves debris into the inlet leg portion 34 exposing the debris to the high energy fluid flow HF created by the angular configuration of the leg portions 34 and 40. FIG. 5 shows the debris dispersed as smaller segments 61*a*. Segments 61 are moved by the turbulence generated in the fluid flow path. There is a reduced likelihood of large clumps of debris moving outside the reach or range of the member 54. If a large clump is presented, it may be fished out of the path as shown in FIG. 4. Once the object or debris is removed from the flow path, rotation member 54 is further rotated (clockwise) to the start or rest position shown in FIG. 3.

One-directional rotation is provided by the use of a ratchet mechanism illustrated in FIG. 7. Although a number of alternative mechanisms may be used, such as slip clutches and engaging dents, FIG. 7 illustrates a simple two-part ratchet 72. A number of projections 72 may be formed into the outer surface of housing half 22A which cooperates with ratchet teeth 72*b* on ratchet hub 73. Projection 72 may be on a separate plate affixed to the housing. Teeth 72*b* are sloped on one side and generally straight on the opposite side (as is well-known in the art) to allow the ratchet hub 73 to easily rotate in one direction (here clockwise) and restricting rotation in the counter direction.

Figure 6:
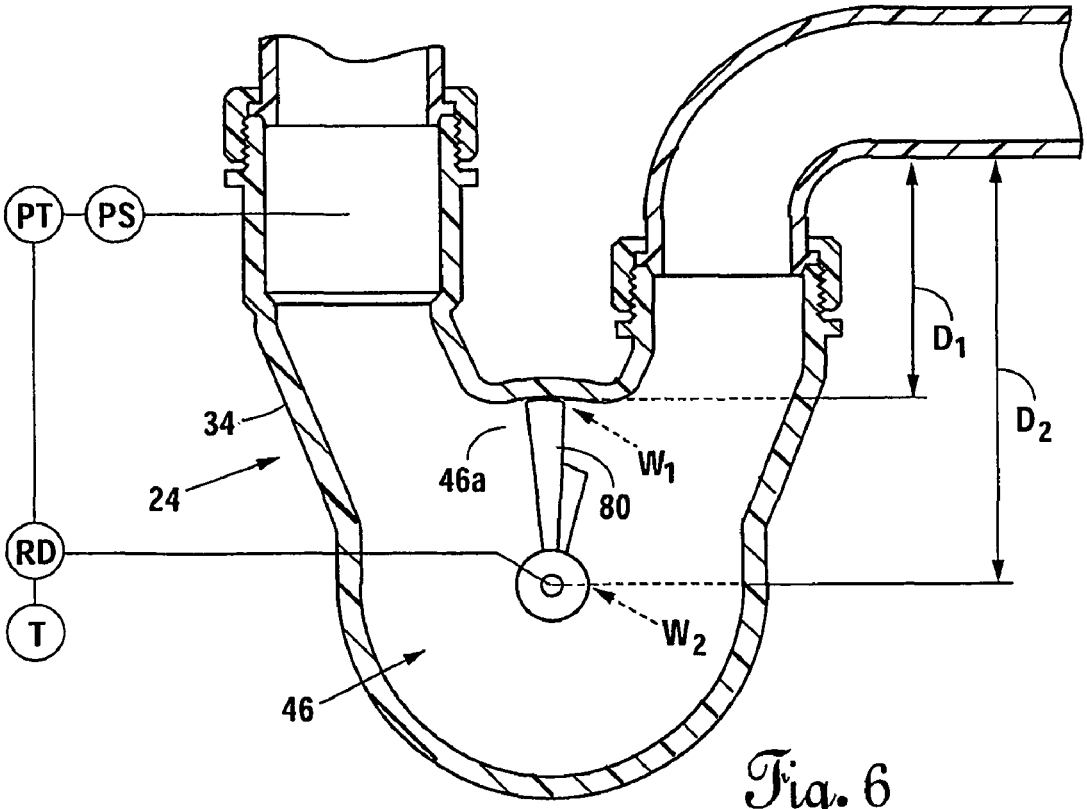
FIG. 6 shows one embodiment of the present invention with a sensing system connected to rotate the rotation member as appropriate. Further illustrated are weir distances maintained by the structural arrangement of the elements of the embodiment.

Rotation of member 54 may be accomplished manually or automatically. FIG. 6 shows a schematic diagram of a sensor system connected to the present invention to activate a rotation device RD connected to the rotation member 54 within the housing. FIG. 6 shows two sensors in the system which causes the member 54 to rotate through the path described above. The first is a pressure or flow sensing probe PS inserted into the inlet portion 24 of the housing 22. The probe senses when a predetermined pressure or flow rate has been reached (indicating a restriction in fluid flow through the apparatus 20) and activates a motor or other driver RD through a pressure transducer PT. In combination, or in the alternative, a timer T may be attached to the rotation device (motor/driver) RD to periodically activate the motor/driver to rotate the member 54 within the chamber 46. The timer system has the advantage of activating the operation of the apparatus before large buildups are accumulated. It should be understood that the operation of the apparatus may be achieved manually by using the hub 60 itself to rotate the journal.

FIG. 6 also illustrates that the apparatus 20 of the present invention meets generally accepted plumbing codes. For example, a uniform code may state that each fixture trap shall have a water seal of not less than two (2) inches (51 mm) and not more than four (4) inches (102 mm) except where a deeper seat is found necessary by the authority having jurisdiction for special conditions or for special designs relating to handicapped accessible fixtures. In the present invention, as shown in FIG. 6, two locations must be taken into account when meeting the requirements of such uniform plumbing codes:

a) Weir 1 ($W_1$) distance D: must be maintained to provide the minimum of 2 inches of water seal depth should the paddle 80 not seal in the upper chamber portion 46*a* or if the paddle is "parked" in a position that does not effect a seal in the upper chamber portion 46*a;* b) Weir 2 ($W_2$) distance $D_2$ must be maintained to provide a maximum of 4 inches of water seal depth should the paddle 80 seal in the upper chamber portion 46*a* either intentionally with a seal such as a gasket or unintentionally by buildup of debris between the paddle 80 and the housing wall. Thus, unlike some prior art devices, the present invention meets the uniform codes.

Figure 8:
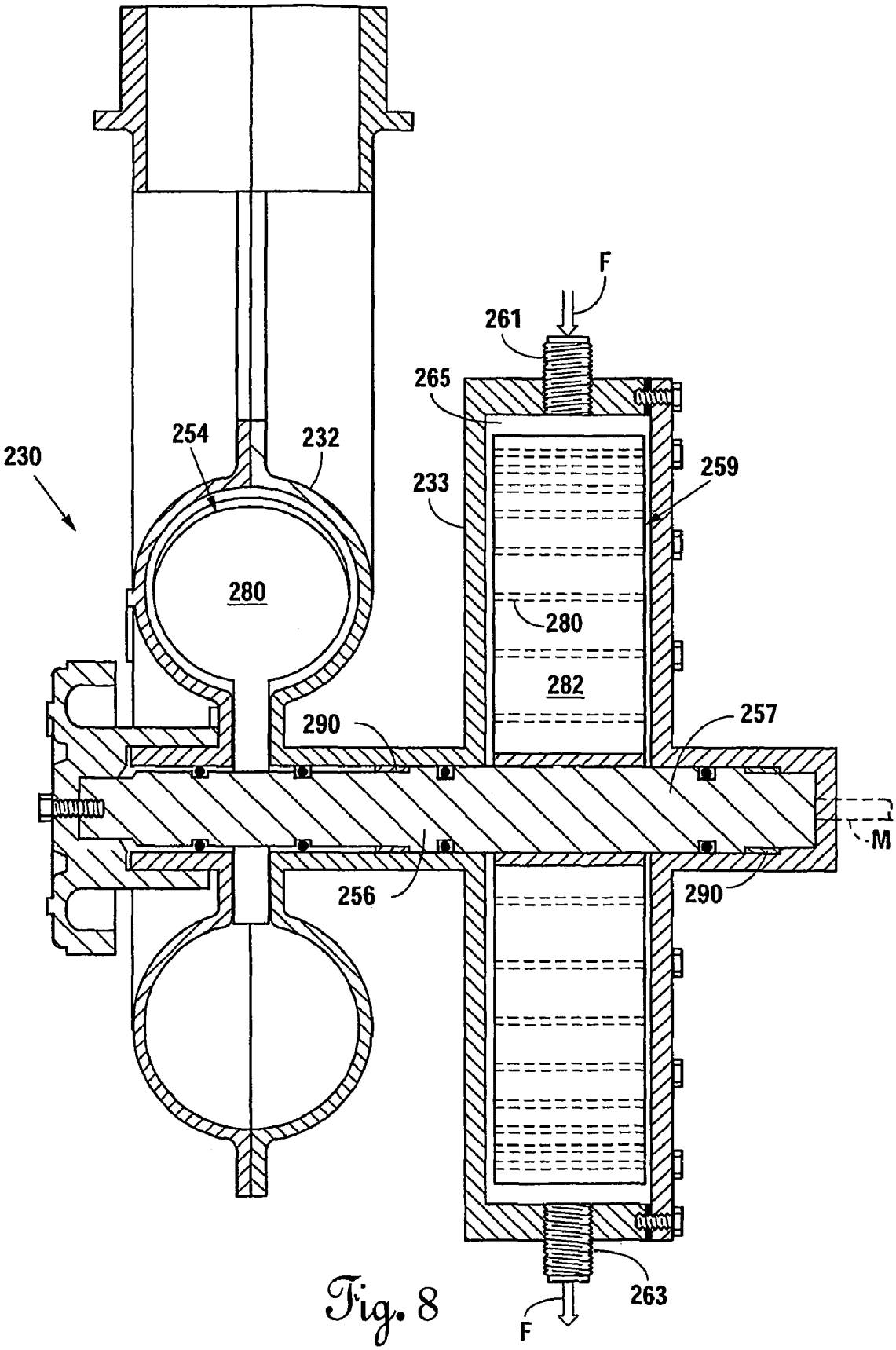
FIG. 8 is a front elevation in cross-section of one embodiment of the present invention having an extended common journal which may be connected to a fluid turbine or electric motor to drive the rotation member.

FIG. 8 illustrates yet another embodiment of the present invention 230 in cross-section. The housing 232 for the rotation member 254 is adapted to include a power housing section 233. In FIG. 8, the plastic housing halves are molded with the power housing section integral with the cleaning member housing section. The axle or rotation journal 256 is extended to include a turbine support journal portion 257 on which is secured a turbine or power wheel member 259. The extended journal is provided with appropriate 8 support bearing 290. the power housing section 233 is provided with an inlet portion 261 and an outlet port 263. A driving fluid (liquid or gaseous) may be injected into inlet port 261 into power chamber 265 causing the turbine wheel 259 to rotate as the driving fluid is discharged through outlet port 263. As the wheel 259 rotates, the journal turbine 257 rotates rotating the axle or rotation journal 256 and the rotation member 254. One of ordinary skill in the art will understand the construction of a turbine or power wheel 259 as having fins or blades 280 extending radially from the wheel body 282 and positioned to convert the incoming energy from the driving fluid F to rotational energy at the turbine journal 257.

In the embodiment of FIG. 8, an alternative driver could be a motor M appropriated coupled to the journal 257. In many applications of the FIG. 8 embodiment, the driving fluid is water which is flowing through the power housing 233, out of outlet port 263, and to a tub or shower. The drain from the tub or shower would have its drain line attached to the inlet feed line of the housing. Thus, it may only be appropriate to rotate the cleaning member when the tub/shower is being utilized and water is draining from the tub/shower. In such an application, the water being used for the tub/shower is the same water which is driving the turbine wheel and rotating the cleaning member.

It has been further found that the rotation member inside the housing may be a fluid injection member (or jet) disposed adjacent the nadir of the bight portion. FIGS. 9-15 illustrate various jet designs.

Figure 9:
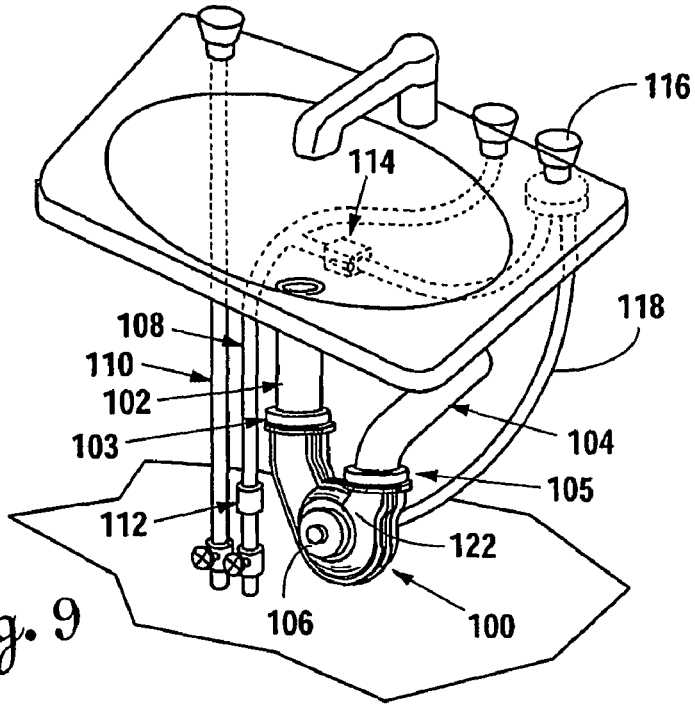
FIG. 9 is an illustration of a plumbing configuration for one embodiment of the present invention having a fluid jet mechanism.

FIG. 9 shows a plumbing configuration for one embodiment of the jet mechanism of the present invention. The jet-trap mechanism 100 is connected between the sink drain 102 and the drain line 104 by suitable couplings 103 and 105. The jet-trap housing assembly 122 contains and supports a jet shaft 106. Shaft 106 may be rotatable or non-rotatable as discussed below in relation to FIGS. 10-13. A fluid (typically water; but in some applications, it may be another liquid or a gas) is provided to the shaft 106 which injects the fluid into the housing 122. FIG. 9 shows the shaft being supplied water from the cold supply line 108, but, again, hot water supply line 110 could be utilized. If potable water is supplied, a check valve or back flow valve 112 must be provide in accordance with uniform codes.

A jet-trap water feed line and valve 114 is taken off the supply feed and directed to the jet-trap control valve 116. From control valve 116, the water enters the shaft 106 in housing 122 through jet-trap supply line 118. As will be described in more detail below, the shaft 106 primarily injects fluid into the bight area from the direction of outlet side of the mechanism 100. This ensures that the excess supplied fluid volume may drain out the outlet side while unclogging is attempted.

Figure 10:
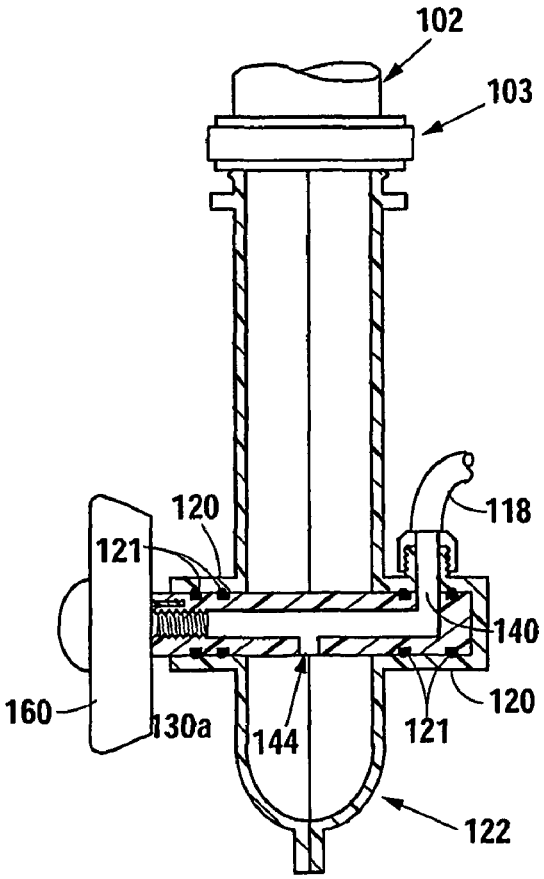
FIG. 10 shows a partial cross-sectional view of a rotatable fluid jet mechanism disposed within the housing assembly.
Figure 13:
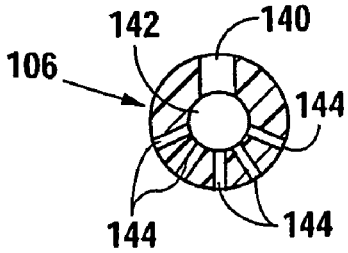
FIG. 13 illustrates an end view cross-section of the jet journal of FIG. 12.

FIG. 10 illustrates an elevation view of an embodiment of the jet design of the present invention in cross-section. This embodiment has a rotatable shaft member 106. One of ordinary skill would understand that the shaft 106 is supported and sealed inside the housing 122 by appropriate bearing housings 120 and seals 121. The front end 130*a* of the shaft 106*a* extends through the front bearing housing and is provided with a hub 160 to rotate the shaft 106. As described above, rotation may be achieved manually or automatically. Jet-trap supply line 118 feeds fluid into shaft inlet 140 which communicates with a central vein or conduit 142 in the shaft 106. Fluid is discharged into the bight portion of the apparatus 100 from jet ports 144 arranged radially around the shaft 106. FIG. 13 shows an end cross-sectional view of one arrangement of jet ports 144.

The rotatable shaft 106 may be provided with a one-direction ratchet mechanism described above to restrict rotation in the direction from the outlet side to the inlet side of the mechanism 100.

Figure 11:
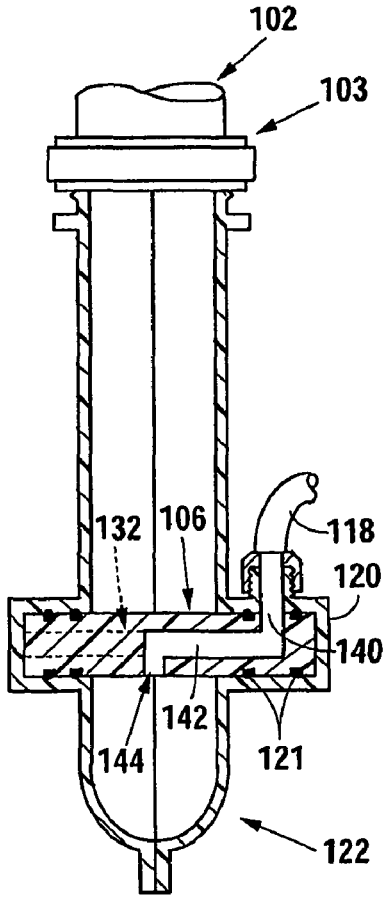
FIG. 11 shows a partial cross-sectional view of an embodiment of the present invention having a non-rotatable fluid jet mechanism.

Some plumbing codes restrict moving parts in a drain trap. FIG. 11 illustrates a non-rotatable jet shaft 106. A vein plug 132 is inserted into vein 142 so that a common shaft may be employed in both rotatable and non-rotatable jet shafts.

Figure 12:
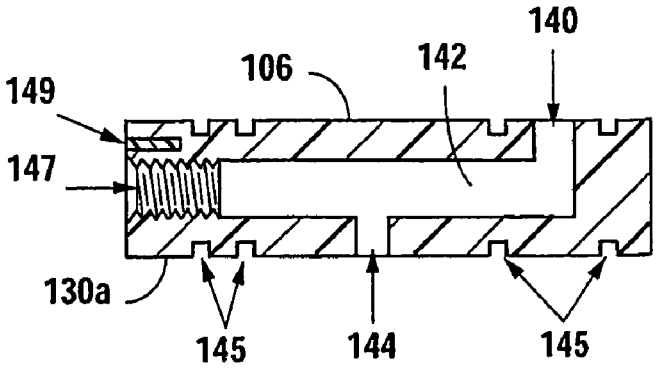
FIG. 12 illustrates in side elevation cross-section a fluid jet journal of one embodiment of the present invention.

A more detailed drawing of the jet shaft 106 is shown in FIG. 12. The shaft is provided with O-ring grooves 145. When a rotation device is used to rotate the shaft, thread 147 may be provided in conduit 142. A splice member 149 is also utilized when necessary.

Figure 14:
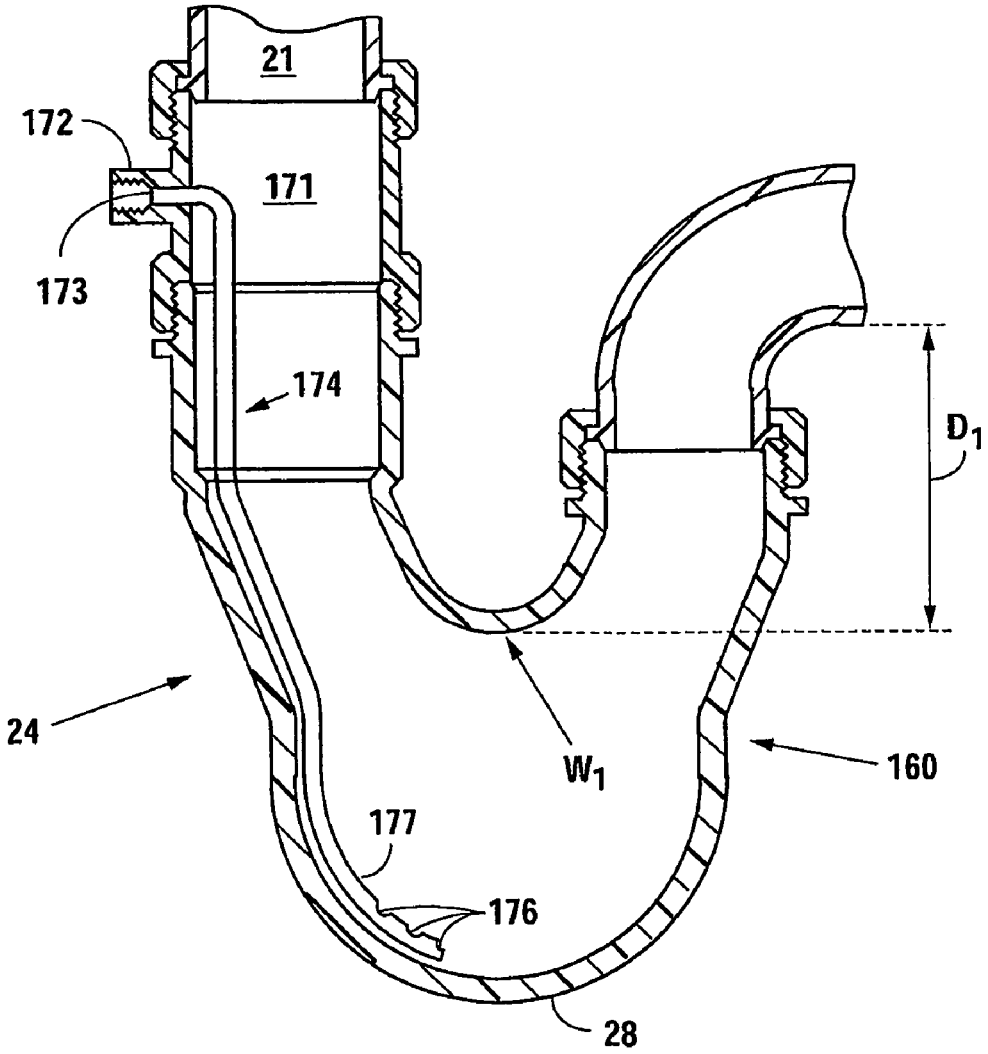
FIG. 14 is a side elevation view of one embodiment of the fluid jet mechanism of the present invention.
Figure 15:
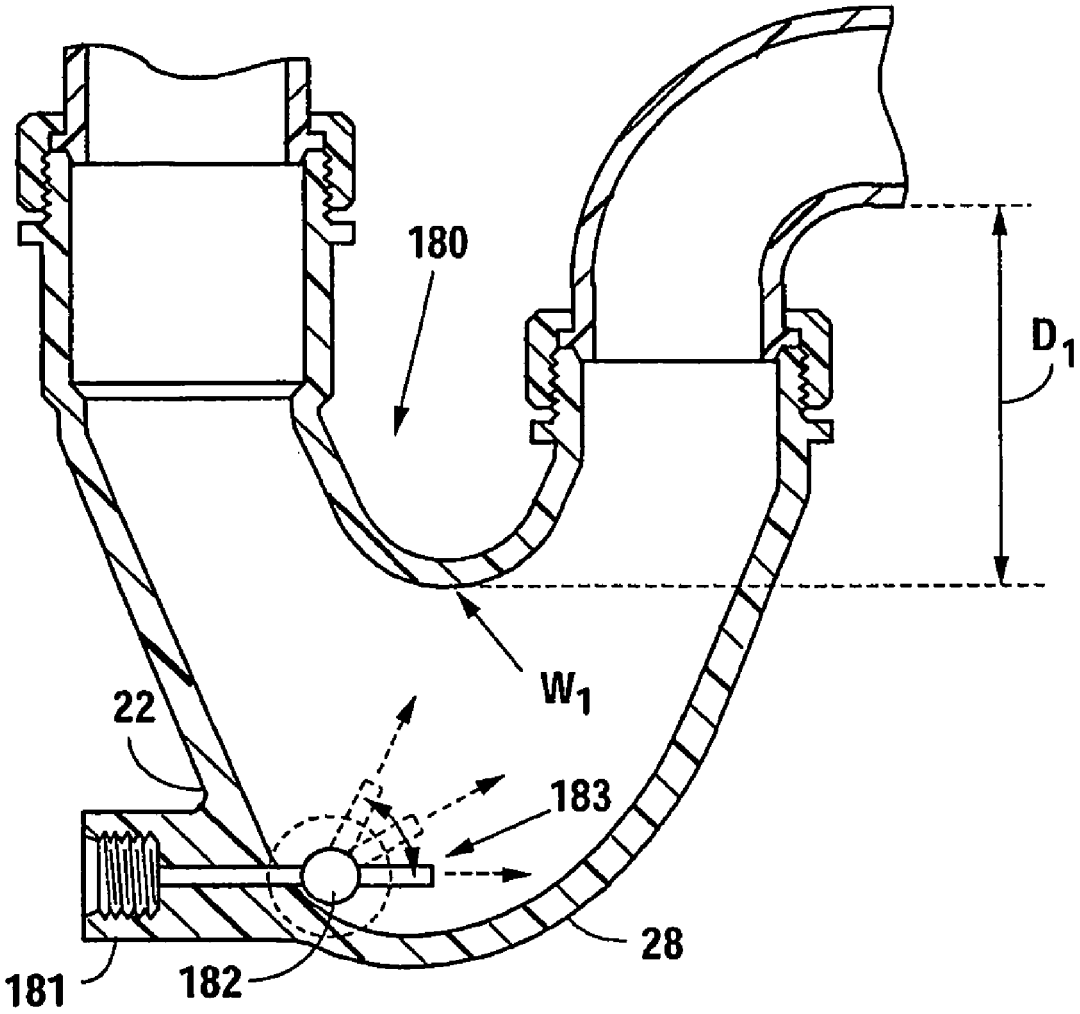
FIG. 15 shows a side elevation view of yet another of the fluid jet mechanism of the present invention.

Other embodiments of the present invention are shown in FIGS. 14 and 15. The tubed jet-trap 160 of FIG. 14 is a simple addition to any drain trap to prevent debris from settling in the bight portion. An adaptor connection 171 is attached to the inlet feed line 21. The adapter has a collar 172 to retain the neck section 173 of a jet tube 174. Tube 174 extends downwardly through the inlet portion 24 of the trap 160 into the bight portion 28. Jet ports 176 are provided at the distal end 177 of the tube to inject jet-supply fluid into the bight portion 28 to dislodge and disperse any clog. It will be noted that the jet tube injects fluid at the nadir of the trap near the bottom of any clog or buildup. Thus, injection from the inlet side of the trap is usually effective.

FIG. 15 illustrates another jet mechanism 180. Adjacent the bight portion 28, an inlet nipple 181 is provided in the wall of the housing 22 in fluid communication with the bight portion. Appropriate plumbing is provided to supply jet-supply fluid through the nipple 181 into the housing. A valve 182 (may be rotatable or non-rotatable) is disposed inside the housing and in fluid communication with the nipple 181. The valve may be constructed similar to the shaft 106 discussed above. A discharge nozzle 183 may be directed at any clog in the bight portion 28 to inject fluid to disperse an obstruction. The nozzle 183 may be rotated to various angular positions to cut and remove debris which may settle in the bight portion. Again, because the fluid is injected at the nadir near the bottom of the clog, the direction of injection may be from the inlet direction to the outlet direction.

All of the embodiments discussed and described above provide a method for cleaning the fluid flow path between an inlet feed line and outlet drain line. The method includes providing an apparatus having a housing assembly forming a chamber with angular inlet and outlet leg portions having longitudinal axes extending therethrough at a sloped angle greater than about 5°, preferably in the range from approximately 15° to approximately 35°, or more preferably at approximately 20°, from the vertical as described above. The apparatus may be further provided with 1) a rotatable member disposed within the housing rotatable only in a direction from the outlet leg portion to the inlet leg portion or 2) a fluid injection member disposed within the housing adjacent the nadir of a bight portion of the housing. The method further includes the steps of attaching the apparatus in fluid communication with the inlet feed line and the outlet drain line.

Although the invention has been described with reference to a specific embodiment, this description is not meant to be construed in a limiting sense. On the contrary, various modifications of the disclosed embodiments will become apparent to those skilled in the art upon reference to the description of the invention. It is therefore contemplated that the appended claims will cover such modifications, alternatives, and equivalents that fall within the true spirit and scope of the invention.

The invention claimed is:

1. A conduit cleaning apparatus connectable to a fluid inlet feed line and an outlet drain line comprising:

a housing assembly having an inlet portion, an outlet portion, and a bight portion connecting said inlet portion and said outlet portion thereby forming a fluid flow path therebetween, said inlet portion comprising:

an inlet connector member at a first end for attachment to said inlet feed line, said inlet connector member having a generally vertical longitudinal axis while in operation;

an inlet leg portion extending from said first end at said connector member to a second end at said bight portion, said inlet leg portion having a longitudinal axis extending therethrough at a sloped angle from said vertical longitudinal axis of said inlet connector member;

said outlet portion comprising:

an outlet connector member at a first end for attachment to said outlet drain line, said outlet connector member having a vertical longitudinal axis;

an outlet leg portion extending from said first end at said outlet connector member to a second end at said bight portion; and said bight portion having a bottom portion, wherein the bottom portion defines a boundary wall for the fluid flow path, and wherein the boundary wall in the bottom portion along the fluid flow path is smooth, continuous and curved.

2. The apparatus of claim 1, wherein the outlet leg portion has a longitudinal axis extending therethrough at a sloped angle, wherein the longitudinal axis of the inlet leg portion slopes downwardly into the bight portion and the longitudinal axis of the outlet leg portion slopes upwardly out of the bight portion and away from the inlet leg portion, and wherein said sloped angles are in the range of approximately 15° to approximately 35°.

3. The apparatus of claim 1, further comprising a rotatable member disposed within said housing assembly and rotatable only in a direction from said outlet leg portion to said inlet leg portion.

4. The apparatus of claim 3, further comprising a rotation device attached to said rotatable member to rotate said rotatable member from a first position within said housing assembly to a second position, said rotation device having a first ratchet portion cooperating with a second ratchet portion on said housing assembly to limit rotational movement of said rotatable member in one direction within said housing assembly from said outlet leg portion to said inlet leg portion.

5. The apparatus of claim 4, further comprising a sensor to activate and rotate said rotation device attached to said rotatable member.

6. The apparatus of claim 4, wherein said rotation device further comprises a driver attached to a common journal rotatably securing said rotation member in said housing assembly.

7. The apparatus of claim 1, further comprising a fluid injection member disposed within said housing assembly adjacent the nadir of said bight portion.

8. The apparatus of claim 7, wherein said fluid injection member is rotatable within said housing.

9. The apparatus of claim 7, wherein said fluid injection member is non-rotatable within said housing.

10. The apparatus of claim 1, wherein said housing assembly is transparent or translucent.

11. The apparatus of claim 1, wherein the inner walls of said inlet leg portion, said outlet leg portions, and said bight portion have hydrophobic coatings.

12. The apparatus of claim 1, wherein the bight portion is a U-shaped fluid trap.

13. The apparatus of claim 1, wherein the bottom portion is the lowermost and outermost portion of the housing assembly.

14. The apparatus of claim 13, wherein the curved shape of the bottom portion of the bight portion is a semi-circular shape.

15. A fluid trap, comprising:

an inlet connector having an upper end and a lower end;

an inlet leg portion extending downwardly from the lower end of the inlet connector, wherein the inlet leg portion extends at an angle with respect to the longitudinal axis of the inlet connector, and wherein the inlet leg portion has an upper end and a lower end;

a trap portion extending downwardly from the lower end of the inlet leg portion, wherein the trap portion has a lowermost and/or outermost wall section along its longitudinal axis that is U-shaped;

an outlet leg portion extending upwardly from the trap portion, wherein the outlet leg portion has an upper end and a lower end, and wherein the lower end of the outlet leg portion is spaced apart from the lower end of the inlet leg portion; and an outlet connector extending upwardly from the upper end of the outlet leg portion, the outlet connector having an upper end and a lower end, wherein the inlet connector, the inlet leg portion, the trap portion, the outlet leg portion and the outlet connector define a fluid flow path having an inlet opening defined by the upper end of the inlet connector and an outlet opening defined by the upper end of the outlet connector, and wherein the direction of the fluid flow path changes between the inlet leg connector and the inlet leg portion and again between inlet leg portion and the trap portion for creating turbulence in the fluid for preventing any solid material that may be in the fluid from settling out of the fluid and depositing in the trap portion.

16. The fluid trap of claim 15, wherein the trap portion has an upper portion and a lower portion, wherein the upper portion of the trap portion is attached to or integral with the lower end of the inlet leg portion, and wherein the upper portion of the trap portion has an essentially straight interior wall that is essentially parallel with the longitudinal axis of the inlet connector.

17. The fluid trap of claim 16, wherein the lower portion of the trap portion has an interior wall that has a semi-circular shape along a longitudinal cross-section, and wherein the upper and lower portions of the trap portion cooperate to provide the U-shape of the lowermost and/or outermost wall section of the trap portion.

18. The fluid trap of claim 15, wherein the fluid trap is a sealed, watertight conduit, except for the inlet and outlet openings.

19. The fluid trap of claim 15, wherein the longitudinal axes of the inlet and outlet connectors are oriented essentially vertically while the fluid trap is in use, wherein the longitudinal axis of the fluid flow path changes in direction between the outlet leg portion and the outlet connector.

20. The fluid trap of claim 19, wherein the longitudinal axis of the fluid flow path changes in direction between the trap portion and the outlet leg portion.

21. The fluid trap of claim 15, wherein the longitudinal axes of the inlet and outlet leg portions intersect within or below the trap portion while the fluid trap is in use.

22. The fluid trap of claim 15, wherein the outlet leg portion has a longitudinal axis, and wherein the longitudinal axis of the outlet leg portion intersects with the longitudinal axis of the inlet leg portion and with the longitudinal axis of the outlet connector.

23. The fluid trap of claim 15, wherein a longitudinal cross-section of the trap portion reveals a wall section that circumscribes a generally circular shape.

24. The fluid trap of claim 15, wherein the inlet and outlet connectors, the inlet and outlet leg portions and the trap portion are formed as two integral longitudinal halves made of a transparent and/or translucent plastic material, and wherein the two halves are attached to one another so that the fluid trap is an integral fluid conduit having said inlet and outlet openings.

25. The fluid trap of claim 15, wherein the trap portion defines a chamber, further comprising a rotatable member received in the chamber, wherein rotation of the rotatable member moves debris and/or an object from rest in a lower part of the trap portion.

26. The fluid trap of claim 25, wherein the rotatable member comprises a journal or shaft rotatably mounted in the trap portion transverse to the fluid flow path, wherein the journal or shaft has at least one end that extends outside of the chamber so that the end of the journal or shaft is not within the fluid flow path, wherein the rotatable member has a paddle and/or a tooth or arm that extends radially from the journal or shaft for contact with the debris and/or object.

27. The fluid trap of claim 26, further comprising a handle or hub attached to the end of the journal or shaft that extends outside of the chamber.

28. The fluid trap of claim 25, further comprising a fluid-driven turbine operatively connected to the end of the journal or shaft that extends outside of the chamber for rotating the rotatable member.

29. The fluid trap of claim 25, further comprising a motor operatively connected to the end of the journal or shaft that extends outside of the chamber for rotating the rotatable member.

30. The fluid trap of claim 25, further comprising:

a fluid-driven turbine or a motor operatively connected to the end of the journal or shaft that extends outside of the chamber for rotating the rotatable member;

means for determining when the rotatable member should be rotated; and means for automatically rotating the rotatable member upon determining that the rotatable member should be rotated.

31. The fluid trap of claim 15, wherein the trap portion defines a chamber, further comprising a jet shaft engaged in the chamber transverse to the fluid flow path, wherein the jet shaft has an inlet port for receiving a source of fluid, an outlet port for injecting the fluid into the chamber and a passageway between the inlet and outlet ports for passage of the fluid through the jet shaft.

32. The fluid trap of claim 31, wherein the jet shaft is rotatable about its longitudinal axis.

33. The fluid trap of claim 15, further comprising a fluid jet received in the trap portion for receiving a stream of fluid through the fluid jet for dispersing an accumulation of debris in the trap portion.

34. The fluid trap of claim 15, wherein the inlet connector, the inlet leg portion, the trap portion, the outlet leg portion and the outlet connector have an inside wall that defines the fluid flow path, and wherein an application of a hydrophobic material is received on the inside wall.

35. The fluid trap of claim 15, wherein the inlet connector, the inlet leg portion, the trap portion, the outlet leg portion and the outlet connector have an inside wall that defines the fluid flow path, and wherein an application of an antibacterial material is received on the inside wall.

36. A fluid trap, comprising:

an inlet connector having an upper end and a lower end;

an inlet leg portion extending downwardly from the lower end of the inlet connector, wherein the inlet leg portion extends at an angle with respect to the longitudinal axis of the inlet connector, and wherein the inlet leg portion has an upper end and a lower end;

a trap portion extending downwardly from the lower end of the inlet leg portion;

an outlet leg portion extending upwardly from the trap portion, wherein the outlet leg portion has an upper end and a lower end, and wherein the lower end of the outlet leg portion is spaced apart from the lower end of the inlet leg portion; and an outlet connector extending upwardly from the upper end of the outlet leg portion, the outlet connector having an upper end and a lower end, wherein the inlet connector, the inlet leg portion, the trap portion, the outlet leg portion and the outlet connector define a fluid flow path having an inlet opening defined by the upper end of the inlet connector and an outlet opening defined by the upper end of the outlet connector, wherein the fluid flow path through the fluid trap has a longitudinal axis comprised of a combination of straight and/or curved lines, wherein the longitudinal axes of the fluid flow path through the inlet and outlet connectors are essentially parallel and spaced apart while the fluid trap is in use, wherein the longitudinal axes of the fluid flow path through the inlet and outlet leg portions intersect to form a shape resembling the letter "V" while the fluid trap is in use, and wherein the trap portion has an interior wall that has a shape resembling the letter "U" along a longitudinal cross-section while the fluid trap is in use.

37. A plumbing drain trap conduit, comprising an inlet connector having upper and lower ends, an inlet leg portion having upper and lower ends, a trap portion, an outlet leg portion having upper and lower ends and an outlet connector having upper and lower ends, wherein the inlet and outlet connectors are oriented essentially vertically while in use and are spaced apart, wherein the upper end of the inlet leg portion extends downwardly from the lower end of the inlet connector while in use, wherein the upper end of the outlet leg portion extends downwardly from the lower end of the outlet connector while in use, wherein the lower ends of the inlet and outlet leg portions are spaced apart and are attached to or formed integral with the trap portion, wherein the lowermost point of an interior wall of the trap portion is below the lowermost point of each of the lower ends of the inlet and outlet leg portions while in use, wherein the wall of the trap portion along a longitudinal cross-section has a curved shape along its lowermost and outermost interior boundary wall, wherein the inlet connector, the inlet leg portion, the trap portion, the outlet leg portion and the outlet connector define a fluid flow path having an inlet opening defined by the upper end of the inlet connector and an outlet opening defined by the upper end of the outlet connector, wherein the fluid flow direction along the fluid flow path while the drain trap conduit is in use is essentially vertically downward through the inlet connector, sloped downwardly toward the trap portion through the inlet leg portion, sloped upwardly from the trap portion through the outlet leg portion and essentially vertically upward through the outlet connector, and wherein the inlet leg portion has an interior boundary wall along a lowermost longitudinal cross-section while in use, wherein the trap portion has an interior boundary wall that abuts said interior boundary wall of the inlet leg portion, wherein said interior boundary wall of the trap portion is angled downwardly with respect to said interior boundary wall of the inlet leg portion while in use for inducing turbulence into a fluid flowing through the drain trap conduit so that any solids in the fluid do not tend to settle out and remain in the trap portion.

38. A conduit for providing a fluid seal, comprising: an inlet section, a fluid seal section and an outlet section, wherein the inlet section, the fluid seal section and the outlet section each have an inlet opening and an outlet opening, wherein while in use:

the inlet section is connected to or formed integral with the fluid seal section such that the outlet opening of the inlet section mates with the inlet opening of the fluid seal section, the outlet section is connected to or formed integral with the fluid seal section such that the outlet opening of the fluid seal section mates with the inlet opening of the outlet section, the inlet section slopes downwardly toward the fluid seal section, the outlet section slopes upwardly away from the fluid seal section, the fluid seal section has an inlet portion that begins at the inlet opening of the fluid seal section, the inlet portion of the fluid seal section drops vertically and/or slopes downwardly at a greater angle than the slope of the inlet section, the fluid seal section has an outlet portion that ends at the outlet opening of the fluid seal section, the outlet portion of the fluid seal section slopes upwardly at a greater angle than the slope of the outlet section and/or rises vertically, the fluid seal section has a central portion between the inlet and outlet portions of the fluid seal section, and wherein a smooth and continuous passageway is defined from the inlet opening of the inlet section through the inlet section, the inlet, central and outlet portions of the fluid seal section, and the outlet section to the outlet opening of the outlet section.

39. A conduit for providing a fluid seal and having means for cleaning a fluid seal passageway, the conduit comprising: an inlet section, a fluid seal section and an outlet section, wherein the inlet section, the fluid seal section and the outlet section each have an inlet opening and an outlet opening, wherein while in use:

the inlet section is connected to or formed integral with the fluid seal section such that the outlet opening of the inlet section mates with the inlet opening of the fluid seal section, the outlet section is connected to or formed integral with the fluid seal section such that the outlet opening of the fluid seal section mates with the inlet opening of the outlet section, the inlet section slopes downwardly toward the fluid seal section, the outlet section slopes upwardly away from the fluid seal section, the fluid seal section has an inlet portion that begins at the inlet opening of the fluid seal section, the inlet portion of the fluid seal section drops vertically and/or slopes downwardly at a greater angle than the slope of the inlet section, the fluid seal section has an outlet portion that ends at the outlet opening of the fluid seal section, the outlet portion of the fluid seal section slopes upwardly at a greater angle than the slope of the outlet section and/or rises vertically, the fluid seal section has a central portion between the inlet and outlet portions of the fluid seal section, the fluid seal section defines a chamber, and wherein a continuous fluid passageway is defined from the inlet opening of the inlet section through the inlet section, the inlet, central and outlet portions of the fluid seal section, and the outlet section to the outlet opening of the outlet section; and a cleaning device received in the chamber, wherein the cleaning device can be rotated through the fluid passageway in the fluid seal section.

40. The conduit of claim 39, further comprising means for rotating the cleaning device.

* * * * *